US005388997A

United States Patent [19]

Grange et al.

[11] Patent Number: 5,388,997

[45] Date of Patent: Feb. 14, 1995

[54] METHOD AND SYSTEM FOR PRODUCING ELECTRICALLY INTERCONNECTED CIRCUITS

[75] Inventors: Jeffrey J. Grange, Brush Prairie, Wash.; J. P. Harmon, Corvallis, Oreg.

[73] Assignee: Hewlett-Packard Company, Palo Alto, Calif.

[21] Appl. No.: 245,513

[22] Filed: May 17, 1994

Related U.S. Application Data

[63] Continuation of Ser. No. 33,693, Mar. 16, 1993, abandoned.

[51] Int. Cl.[6] ..... H01R 9/09; H01R 13/15

[52] U.S. Cl. ..... 439/66; 439/263; 439/247; 439/591; 439/908

[58] Field of Search ..... 439/66, 245, 247, 248, 439/262, 263, 591, 840, 841, 908

[56] References Cited

U.S. PATENT DOCUMENTS

| | | | |
|---|---|---|---|
| 4,029,375 | 6/1977 | Gabrielian . | |
| 4,417,776 | 11/1983 | Motoyama . | |
| 4,528,500 | 7/1985 | Lightbody et al. . | |
| 4,577,200 | 3/1986 | Rix et al. | 346/140 R |
| 4,706,097 | 11/1987 | Harmom | 346/139 C |
| 4,707,657 | 11/1987 | Boegh-Petersen | 439/66 |
| 4,755,836 | 7/1988 | Ta et al. | 346/140 R |
| 4,849,772 | 7/1989 | Ten Broeck et al. | 346/139 R |
| 4,862,197 | 8/1989 | Stoffel | 346/140 R |
| 4,871,315 | 10/1989 | Noschese | 439/67 |
| 4,872,026 | 10/1989 | Rasmussen et al. | 346/140 R |
| 4,881,901 | 11/1989 | Mendenhall et al. | 439/65 |
| 4,988,306 | 1/1991 | Hopfer, III et al. | 439/591 |
| 5,174,763 | 12/1992 | Wilson | 439/66 |
| 5,295,839 | 3/1994 | Grange et al. | 439/67 |

FOREIGN PATENT DOCUMENTS

| | | |
|---|---|---|
| 0240710 | 10/1987 | European Pat. Off. . |
| 3115787 | 11/1982 | Germany . |
| 2189657 | 10/1987 | United Kingdom . |
| WOA9014750 | 11/1990 | WIPO . |
| WOA9208258 | 5/1992 | WIPO . |

OTHER PUBLICATIONS

US Patent Application S/N 08/033,692, Filed Mar. 16, 1993 (Grange, et al).

Roy T. Buck, Printhead Interconnect, May 1985, Hewlett-Packard Journal (p. 14).

*Primary Examiner*—David L. Pirlot

*Assistant Examiner*—Daniel Wittels

[57] ABSTRACT

A system is provided for effectively and efficiently interconnecting a first rigid circuit with a second rigid circuit. The interconnected circuit system includes, in addition to the first and second circuits, a compressive conductive member and a rigid conductive member. The compressive conductive member has a first end for interconnecting engagement with the first circuit and a second end for interconnecting engagement with a first end of the rigid conductive member. The rigid conductive member has a first end for interconnecting engagement with the compressive conductive member and a second end for interconnecting engagement with the second circuit. The first end of the compressive conductive member interconnectingly engages with the first end of the rigid conductive member. The second end of the rigid conductive member interconnectingly engages with the first circuit and the second end of the compressive conductive member interconnectingly engages with the second circuit. In this way, the first circuit and the second circuit together form a completed electrical circuit.

24 Claims, 1 Drawing Sheet

METHOD AND SYSTEM FOR PRODUCING ELECTRICALLY INTERCONNECTED CIRCUITS

CROSS REFERENCE TO RELATED APPLICATION(S)

This is a continuation of application Ser. No. 08/033,693, filed on Mar. 16, 1993, now abandoned.

BACKGROUND OF THE INVENTION

This invention relates generally to methods and systems for producing electrically interconnected circuits, and more particularly to electrically interconnected circuits which are especially adapted for making external electrical connections to thermal ink jet printheads.

It is known to provide heater resistors on a common substrate, such as silicon, and employ these resistors to transfer thermal energy to corresponding adjacent ink reservoirs during a thermal ink jet printing operation in the manufacture of thin film resistors substrates for thermal ink jet printheads. This thermal energy will cause the ink in the reservoirs to be heated to boiling and thereby be ejected through an orifice in an adjacent nozzle plate from which it is directed onto a print medium. These heater resistors are electrically pulsed during such operation by current applied thereto via conductive traces formed on top of the silicon substrates and insulated therefrom by an intermediate dielectric layer. The formation of an intermediate dielectric layer, the formation of the resistive layer for the heater resistors, and the aluminum evaporation of sputtering process for forming electrical patterns of conductive trace material to the heater resistors are all well known in the art and therefore are not described in further detail herein. The processes used in the fabrication of thermal ink jet printheads are discussed in the Hewlett Packard Journal, Volume 36, Number 5, May 1985 ("HP Journal Article"), which is incorporated herein by reference. Hewlett Packard Corporation is the assignee of the entire right, title and interest in the subject patent application.

Electrical connections are provided between external pulse drive circuits and the conductive traces on the thermal ink jet printhead using flexible or "flex" circuits to make removable pressure contacts to certain conductive terminal pads on thin film resistor printhead substrates or to tape automated bonding (TAB) circuits. These electrical connections are facilitated by applying pressure to the flexible circuit so that the electrical leads therein make good electrical connection with corresponding mating pads on the thin film resistor printhead substrate. These flexible circuit generally comprise photolithographically defined conductive patterns formed by various etching processes carried out on a thin flexible insulating substrate member. The electrical contact locations on the flex circuit will be raised slightly in a bump and dimple configuration. This configuration is formed using a punch structure which matches the location of the correspondingly dimples. The punch structure is used to form the electrical contact locations on the flex circuit at raised locations above the surface of the insulating substrate member. During this punch process, it sometimes happens that not all of the raised contact bumps in the flexible circuit are moved the same distance above the insulating substrate surface thereby producing a nonuniform dimple configuration. For this reason, more force is necessary to make contact with the smaller, or lower height bumps than those higher bumps more extended from the surface of the flex circuit. When a significant force is exerted against the flex circuit by the printhead in order to interconnect same, crushing of a portion of the raised dimple structure will result. Furthermore, the presence of a nonuniform dimple configuration will prevent contact of the printhead and flexible circuit at their interface.

Other problems result from the use of a dimpled configuration per se. The raised dimple structure formation process is expensive to fabricate and requires high contact forces in its implementation. Moreover, there is poor control over the point geometry of that formation process. Spacing of the dimples in the overall dimple configuration is also a problem because they need to be spaced a relatively close intervals. However, spacing is limited by the thickness and fragility of the metal employed to form the dimpled structure. The close spaced dimpled structure, which is unique to ink jet printing, is quite difficult to manufacture.

Contact between the flex circuit and conductive pads on the TAB circuit can be maintained by using an elastomeric material, such as rubber, which has been preformed to have a plurality of cones spaced at locations corresponding to the location of the dimples in the flex circuit. The tips of these elastomeric cones can be inserted into the dimples of the flex circuit and urged thereagainst with a force sufficient to bring the conductive bumps on the flex circuit in to good physical and electrical contact with the terminal pads on the TAB circuit.

A contact array (see FIG. 1 of the HP Journal Article) can be integrated with a flexible printed circuit that carries the electrical drive pulses to the printhead. Connector mating is achieved by aligning the printhead cartridge registration pins with the mating holes in the carriage/interconnect assembly and then rotating a cam latch upward or pivoting the printhead into position. In this way, electrical contact can be made without lateral motion between the contact halves. The contact areas are backed with silicon-rubber pressure pads (see FIG. 2 of the HP Journal Article) which allow electrical contact to be maintained over a range of conditions and manufacturing tolerances. Electrical contact is enhanced by dimpling the flexible circuit pads. The dimples are formed on the flexible circuit before the plating is applied.

While the above prior art approach to making electrical contact between the flex circuit and the print-head substrate has proven satisfactory for certain types of interconnect patterns with few interconnect members, it has not been entirely satisfactory for low voltage signal contacts. This fact has been a result of the nature of the nonlinear deflection of the above elastomeric cones. This nonlinear deflection of the elastomeric cones is seen as a nonlinear variation of cone volumetric compression, "V", as a function of the distance, "D", that the tip of the cone is moved during an interconnect operation. Thus, this nonlinear characteristic tends to increase the amount of force which must be applied to the flex circuit in order to insure that all the bumps on the flex circuit make good electrical contact with the conductive traces of terminal pads on the printhead substrate. In some cases this required force is sufficiently large to fracture the substrate or do other structural damage thereto. This non-linear deflection characteristic of the prior art is described in more detail below with reference to the prior art FIGS. 1A and 1B of U.S.

Pat. No. 4,706,097, which is incorporated herein by reference.

In order to reduce the amount of force required to insure good electrical contact between a flex circuit and a TAB circuit for a thermal ink jet printhead, a novel, nearly-linear spring connect structure for placing the flex circuit into good electrical contact with contact pads on the printhead substrate with a minimum of force applied thereto was developed. This structure is set forth in the U.S. Pat. No. 4,706,097. This spring connect structure includes a central locating member having a plurality of cylinders extending integrally therethrough and therefrom to a predetermined distance from each major surface of the central locating member. Cone-shaped tips located at upper ends of the elastomeric deflectable cylinders are inserted into dimples of the flexible circuit with a force sufficient to bring the electrical bumps or pads above the dimples into good electrical contact with mating conductive contact pads on the printhead substrate. The volumetric deformation of the elastomeric deflectable cylinders varies substantially linearly as a function of the force applied to the lower ends of these cylinders. This feature enables the vertical displacement of the cylinder walls to be maximized for a given force applied to these cylinder.

The above-described rubber parts present a problem to the user. More specifically, in order to function in the manner described above, the rubber components must be manufactured to a high level of precision. However, precision rubber components are difficult at best to manufacture.

SUMMARY OF THE INVENTION

The subject invention overcomes the problems associated with the prior art interconnected devices by providing a system which is capable of effectively and efficiently interconnecting a first rigid circuit, in the form of a first rigid circuit board or stiffened flex circuit, with a second rigid circuit, in the form of a second rigid circuit board or stiffened flex circuit. The system of the present invention can be employed in conjunction with circuits including a nonuniform raised dimple configuration. In spite of this, a good contact between the first and second circuits at their interface can be maintained. Therefore, when a significant force is exerted against the first circuit by the second circuit for purposes of interconnectingly engaging the system of this invention, crushing of the raised dimple structure will not result. In fact, the flex circuit no longer requires the dimples described in U.S. Pat. No. 4,706,097 in order to form a completed electrical circuit. In this way, a good electrical contact will exist between the respective circuits.

The interconnected circuit system includes, in addition to the first and second circuits, a compressive conductive member and a rigid conductive member. The first circuit has means for interconnecting engagement with a compressive conductive member. The second circuit has means for interconnecting engagement with a rigid conductive member. The compressive conductive member has a first end for interconnecting engagement with the first circuit and a second end for interconnecting engagement with a first end of the rigid conductive member. The rigid conductive member has a first end for interconnecting engagement with the compressive conductive member and a second end for interconnecting engagement with the second circuit. The first end of the compressive conductive member interconnectingly engages with the first end of the rigid conductive member. The second end of the rigid conductive member interconnectingly engages with the first circuit and the second end of the compressive conductive member interconnectingly engages with the second circuit. In this way, the first circuit and the second circuit together form a completed electrical circuit.

Preferably, the compressive conductive member comprises a conductive spring, more preferably a conductive coil spring. The rigid conductive member comprises a plunger member which interconnectingly engages the second circuit which typically comprises a TAB circuit or printhead substrate.

The system of the present invention can further include a carrier member including means for receiving and maintaining the rigid conductive member in interconnecting engagement with the flexible circuit. The rigid conductive member is introduced into the carrier member and interconnectingly engages the rigid conductive member and the first circuit. Either or both of the rigid conductive member and the compressive conductive member can be fabricated of either one of a metallic material and a conductive polymer.

The second end of the rigid conductive member is generally formed in a configuration which will facilitate engagement with the first circuit. Preferably, the second end of the rigid conductive member is formed in a substantially pointed or rounded configuration.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

Figure 1:
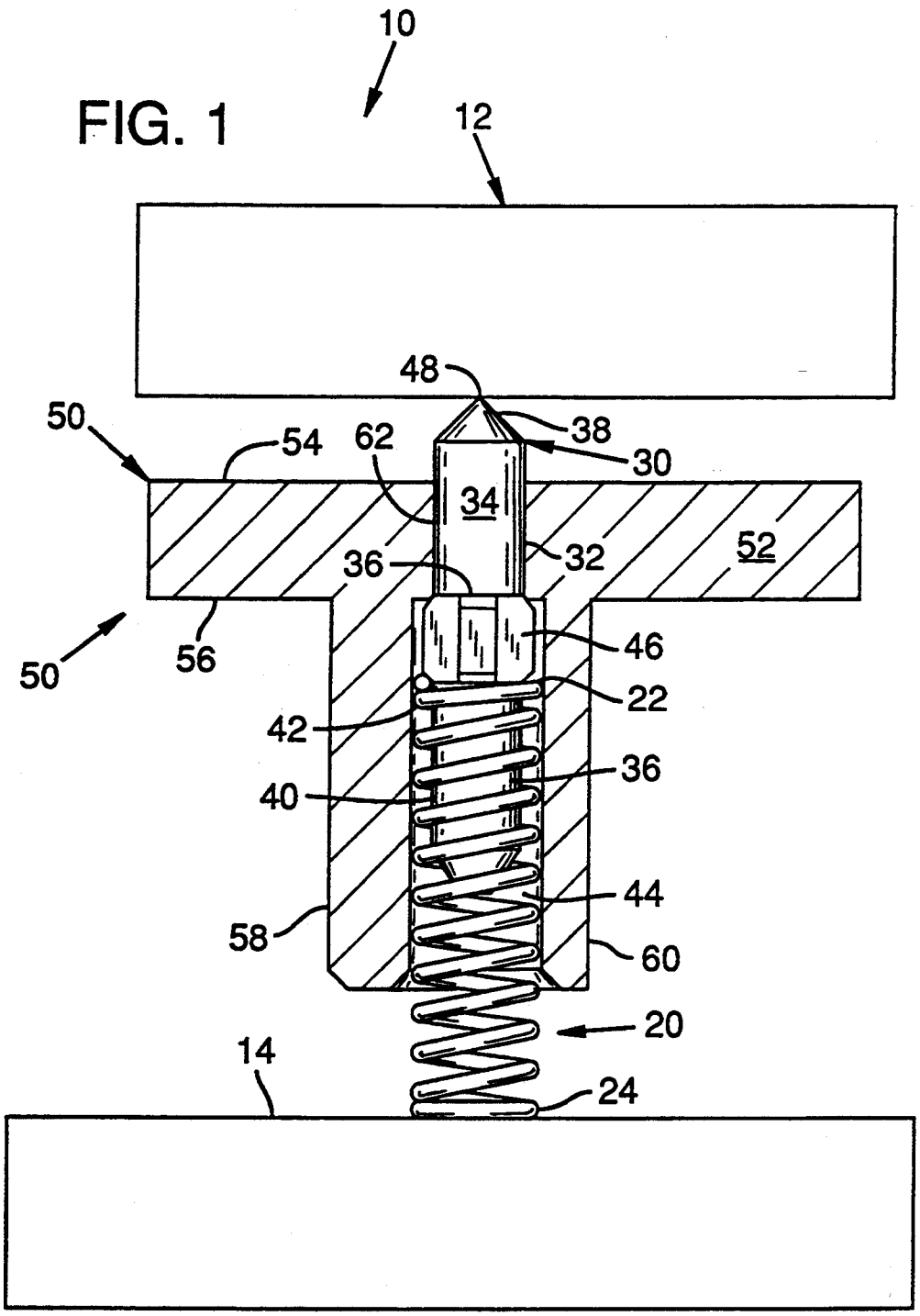
FIG. 1 is a schematic representation of an interconnected circuit system including a compressive conductive member and a rigid conductive member.

Referring now to FIG. 1, an interconnected circuit-to-circuit system 10 is schematically shown. The system 10 includes a thin film resistor rigid printhead substrate or a TAB circuit 12, such as the Hewlett Packard Deskjet® printhead, which has been fabricated using state-of-the art semiconductor processing technique.

It is desired to connect the printhead substrate or TAB circuit 12 to a circuit 14 which can comprise a rigid circuit or a stiffened flexible or "flex" circuit member. More specifically, circuit 14 can comprise a rigid circuit such as conventional printed circuit board with plated conductive metal pads, or a stiffened flexible circuit, such as conventional flex circuit laminated to a stiffened member or to a rigid member such as a PC board or to a rigid flat sheet of metal or plastic.

The printhead substrate or TAB circuit 12 and the circuit member 14 are interconnected via a compressive conductive member 20 in combination with a rigid conductive member 30. The compressive conductive member 20 is a conductive spring member, having first and second ends 22 and 24. More particularly, compressive conductive member 20 comprises a conductive coil spring, can fabricated of a conductive metal such as music wire, or beryllium-copper or stainless steel plated with gold or palladium metal. Compressive conductive member 20 can also be fabricated of a conductive polymeric material such as a metal-loaded or carbon-loaded elastomeric material.

The rigid conductive member 30, which is typically a plunger member 32, comprises a first stem section 34 having an inner end 36 and an outer end 38 including pointed end 48, and second stem section 40 having an inner end 42 and an outer end 44. Inner ends 36 and 42 of first and second stem sections 34 and 40 are respectively joined to an intermediate section 46. Rigid conductive member 30 has an overall generally cylindrical configuration. Intermediate section 46 is designed to have a larger relative cross-sectional diameter than first and second stem sections 34 and 40.

The outer end 38 of first stem section 34 is designed to interlockingly engage printhead substrate or TAB circuit 12 by interconnection of the rigid conductive member 30 therewith. As shown in FIG. 1, outer end 38 has a pointed configuration which is fabricated to interconnectingly engage with TAB circuit or printhead substrate 12. In this way, conductive member 30 and TAB circuit or printhead substrate 12 are in intimate contact with each other thereby maintaining the requisite electrical circuit. Referring now to FIG. 2, outer end 38' has a generally rounded configuration for interlockingly engaging printhead substrate or TAB circuit 12.

The inner cross-sectional diameter of compressive conductive member 20 is designed to interconnectingly fit about the outer surface of second stem section 40. Furthermore, the first end 22 of compressive conductive member 20 engages and is limited by intermediate section 46. Thus, substantial compressive forces are maintained during use on both the rigid conductive member 30 and printhead substrate or TAB circuit 12 by compressive conductive member 20.

The interconnected system 10 is maintained intact with compressive conductive member 20 and rigid conductive member 30 being in an interconnectingly engaged position so that the longitudinal axis of members 20 and 30 are substantially perpendicular to circuit member 14 and to printhead substrate or TAB circuit 12, respectively, through the use of a carrier member 50. Carrier member 50 comprises a support base member 52, having outer surfaces 54 and 56, and a support wall 60 which is joined to and extending substantially perpendicular from the outer surface 56. The carrier member 50 also defines an aperture 62 in the center of base member 52 which passes through outer surfaces 54 and 56. Aperture 62 is sized to matingly receive first stem section 34. In use, first stem section 34 is in fitting engagement with base 52 within aperture 62, with intermediate section 46 in contact with second surface 56 of base member 52. At the same time, compressive conductive member 20 is maintained in a substantially vertical position within the space defined by support wall 60 of carrier member 50. The outer end 38 of first stem section 34 extends outwardly from within aperture 62 so pointed end 48 interlockingly engages circuit 12.

A prior art near-linear spring contact structure, denoted "58", is depicted in FIGS. 3A and 4 and in column 4, lines 3–59 of previously described U.S. Pat. No. 4,706,097. The compressive conductive member and a rigid conductive member of this invention also comprise a near-linear spring contact structure for the circuits 12 and 14, while acting to interconnect the subject circuit system 10. This means that the circuit system 10 of the present invention has a significantly lower final load $L_1$ requirement. As explained in detail in U.S. Pat. No. 4,706,097, this causes the printhead substrate or TAB circuit 12 to remain in intimate contact with the circuit 14 during use. This feature provides a design which ensures a high level of electrical contact therebetween. Similarly, circuit member 14 and to printhead substrate or TAB circuit 12 are maintained in continuous electrical contact. This is accomplished through the use of the system 10 of the subject invention in which compressive conductive member 20 and rigid conductive member 30 are in intimate contact with each other and respectively with printhead substrate or TAB circuit 12 and circuit member 14.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

We claim:

1. A method for interconnecting a first circuit to a second circuit, which comprises providing a first circuit and a second circuit;

providing a compressive conductive member and a rigid conductive member which acts as a near-linear spring contact structure for said first circuit and second circuit, the compressive conductive member having a first end for interconnecting engagement with the first circuit and a second end for interconnecting engagement with a first end of the rigid conductive member, the rigid conductive member having a first end for interconnecting engagement with the compressive conductive member and a second end for interconnecting engagement with the second circuit;

connecting the second end of the compressive conductive member with the first end of the rigid conductive member; and connecting the second end of the rigid conductive member with the second circuit and the first end of the compressive conductive member with the first circuit to connect the first circuit to the second circuit to form a completed electrical circuit which, due to the compressive conductive member and the rigid conductive member acting as a near-linear spring contact structure having a significantly lower final load $L_1$ requirement, the first circuit remains in intimate contact with the second circuit, and the amount of force required to ensure a high level of electrical contact between the first and second circuit is substantially reduced.

2. The method of claim 1, wherein the rigid conductive member comprises a plunger member which interconnectingly engages the second circuit, the second circuit comprising either one of a printhead substrate and a TAB circuit.

3. The method of claim 1, which further includes the steps of providing a carrier member including means for receiving and maintaining the rigid conductive member in interconnecting engagement with the second circuit; introducing the rigid conductive member and compressive conductive member into the carrier member; and interconnectingly engaging the rigid conductive member and the second circuit, and the compressive conductive member and the first circuit.

4. The method of claim 1, which further includes the step of fabricating either one of the rigid conductive member and the compressive conductive member of either one of a metallic material and a conductive polymer.

5. The method of claim 1, wherein the first circuit comprises a rigid circuit or stiffened flex circuit and the second circuit comprises one of a rigid circuit or a stiffened flexible circuit.

6. The method of claim 1, wherein the second end of the rigid conductive member is formed in a substantially pointed configuration.

7. The method of claim 1, wherein the second end of the rigid conductive member is formed in a substantially rounded configuration.

8. The method of claim 1, wherein the compressive conductive member comprises a conductive coil spring.

9. The method of claim 1, wherein the compressive conductive member comprises a conductive spring.

10. The method of claim 9, wherein the rigid conductive member comprises a plunger member which interconnectingly engages the second circuit, the second circuit comprising either one of a printhead substrate and a TAB circuit.

11. The method of claim 10, which further includes the steps of providing a carrier member including means for receiving and maintaining the rigid conductive member in interconnecting engagement with the second circuit; introducing the rigid conductive member and compressive conductive member into the carrier member; and interconnectingly engaging the rigid conductive member and the second circuit, and the compressive conductive member and the first circuit.

12. An interconnected rigid circuit-flexible circuit system, which comprises a first circuit and a second circuit;

a compressive conductive member and a rigid conductive member which acts as a near-linear spring contact structure for said first circuit and second circuit, the compressive conductive member having a first end for interconnecting engagement with the first circuit and a second end for interconnecting engagement with a first end of the rigid conductive member, the rigid conductive member having a first end for interconnecting engagement with the compressive conductive member and a second end for interconnecting engagement with the second circuit;

the second end of the compressive conductive member being connected with the first end of the rigid conductive member; and the second end of the rigid conductive member being connected with the second circuit and the first end of the compressive conductive member being connected with the first circuit to connect the first circuit to the second circuit to form a completed electrical circuit which, due to the compressive conductive member and the rigid conductive member acting as a near-linear spring contact structure having a significantly lower final load $L_1$ requirement, the first circuit remains in intimate contact with the second circuit, and the amount of force required to ensure a high level of electrical contact between the first and second circuit is substantially reduced.

13. The system of claim 20, wherein the rigid conductive member comprises a plunger member which interconnectingly engages the second circuit, the second circuit comprising either one of a printhead substrate and a TAB circuit.

14. The system of claim 12, which further includes a carrier member including means for receiving and maintaining the rigid conductive member in interconnecting engagement with the second circuit; introducing the rigid conductive member and compressive conductive member into the carrier member; and interconnectingly engaging the rigid conductive member and the second circuit, and the compressive conductive member and the first circuit.

15. The system of claim 12, wherein either one of the rigid conductive member and the compressive conductive member are fabricated of either one of a metallic material and a conductive polymer.

16. The system of claim 12, wherein the first circuit comprises a rigid circuit or stiffened flex circuit and the second circuit comprises one of a rigid circuit or a stiffened flexible circuit.

17. The system of claim 12, wherein the second end of the rigid conductive member is formed in a substantially pointed configuration.

18. The system of claim 12, wherein the second end of the rigid conductive member is formed in a substantially rounded configuration.

19. The interconnected rigid circuit-flexible circuit system of claim 12, wherein the compressive conductive member comprises a conductive coil spring.

20. The system of claim 12, wherein the compressive conductive member comprises a conductive spring.

21. The system of claim 20, wherein the rigid conductive member comprises a plunger member which interconnectingly engages the second circuit, the second circuit comprising either one of a printhead substrate and a TAB circuit.

22. The system of claim 21, which further includes a carrier member including means for receiving and maintaining the rigid conductive member in interconnecting engagement with the second circuit; introducing the rigid conductive member and compressive conductive member into the carrier member; and interconnectingly engaging the rigid conductive member and the second circuit, and the compressive conductive member and the first circuit.

23. An apparatus for connecting a first circuit to a second circuit, which comprises a compressive conductive member which acts as a near-linear spring contact structure for said first circuit and second circuit, the compressive conductive member having a first end for interconnecting engagement with the first circuit and a second end for interconnecting engagement with a first end of the rigid conductive member, the rigid conductive member having a first end for interconnecting engagement with the compressive conductive member and a second end for interconnecting engagement with the second circuit;

the second end of the compressive conductive member being connected with the first end of the rigid conductive member, the second end of the rigid conductive member being connected with the second circuit and the first end of the compressive conductive member being connected with the first circuit connecting the first circuit to the second circuit to form a completed electrical circuit which, due to the compressive conductive member and the rigid conductive member acting as a near-linear spring contact structure having a significantly lower final load $L_1$ requirement, the first circuit remains in intimate contact with the second circuit, and the amount of force required to ensure a high level of electrical contact between the first and second circuit is substantially reduced.

24. The apparatus for connecting a first circuit to a second circuit of claim 23, wherein the compressive conductive member comprises a conductive coil spring.

* * * * *